US005578353A

United States Patent [19]

Drew, III

[11] Patent Number: 5,578,353

[45] Date of Patent: Nov. 26, 1996

[54] TATTOO ADMISSION TICKET

[76] Inventor: James H. Drew, III, 3531 Walton Way, Ste. B, Augusta, Ga. 30909

[21] Appl. No.: 477,803

[22] Filed: Jun. 7, 1995

[51] Int. Cl.[6] ..... B65D 65/28; G09F 3/00

[52] U.S. Cl. ..... 428/43; 283/58; 428/195; 428/906; 428/913; 428/914; 446/296

[58] Field of Search ..... 428/76, 913, 195, 428/914, 906, 43; 446/296; 283/58

[56] References Cited

U.S. PATENT DOCUMENTS

| | | | |
|---|---|---|---|
| 1,240,266 | 9/1917 | Stoiber | 283/53 |
| 2,416,528 | 2/1947 | Land | 88/29 |
| 3,379,176 | 4/1968 | Propst | 119/1 |
| 4,024,287 | 5/1977 | Golchert | 426/383 |
| 4,156,539 | 5/1979 | Davidson | 283/7 |
| 4,169,169 | 9/1979 | Kitabatake | 427/149 |
| 4,209,189 | 6/1980 | Betterley | 283/18 |
| 4,337,289 | 6/1982 | Reed et al. | 428/195 |
| 4,522,864 | 6/1985 | Humason | 428/201 |
| 4,594,276 | 6/1986 | Relya | 428/40 |
| 4,872,706 | 10/1989 | Brewen | 283/81 |
| 5,421,765 | 6/1995 | Lehmann | 446/296 |

*Primary Examiner*—Nasser Ahmad
*Attorney, Agent, or Firm*—Lorusso & Loud

[57] ABSTRACT

A strip of general admission tickets having a transferrable "body tattoo" on each ticket for transfer to the skin for purposes of identifying a person as having paid for admission. The ticket strip is divided into separable individual tickets by widthwise rows of perforations. Each ticket in the strip includes a substrate and ink indicia coated onto said substrate, which indicia are transferrable to the skin of the party paying admission by wetting with a transfer solution and pressing the ink indicia against the skin.

9 Claims, 1 Drawing Sheet

TATTOO ADMISSION TICKET

BACKGROUND OF THE INVENTION

1. Field of the Invention

The present invention relates to an improvement in general admission tickets of the type generally sold in rolls to operators of amusement parks, theme parks, athletic stadiums and arenas, etc.

2. The Prior Art

The problem of integrity of proof of payment of admission price has long been a problem for promoters of music and sport events, amusement park operators, circuses and other such events which charge a general admission price.

Perhaps the most common ticketing procedure involves the purchase of a ticket, typically detached from a roll of tickets by tearing along a row of perforations. After purchase of the ticket, admission is attained by presenting the ticket to a ticket taker posted at a gate opening into the amusement park, arena, stadium, theater, etc. The ticket purchaser is usually given a stub of the ticket, torn off by the ticket taker, which is retainer as proof of payment for the admission. Thus, at many events, an attendee may leave the premises of the event, for which admission has been paid, or may leave an assigned seat, but is allowed to return upon presentation of the ticket stub.

Obviously, the above described use of ticket stubs for readmission is subject to abuse by transfer from one party to another. This is especially true of a general admission ticket to a theme park, amusement park or any event having a repetition of acts or shows throughout the day. In order to prevent such abuse, many events provide a hand stamp, i.e. an ink image, applied to the back of the hand which may or may not fluoresce and thereby be detected by visual inspection under a fluorescent lamp, as the payor returns to his seat or to the premise of the event. However, the hand stamp is also subject to abuse. One abuse is by duplication of the ink image by pressing the hand bearing the ink stamp, before the ink dries, against the hand of another person. Another area of abuse of hand stamping involves dishonesty on the part of the party employed as the ticket taker who accepts the ticket and, in return, applies a hand stamp. Attendees may innocently present money to the employee applying the hand stamp, as opposed to first buying a ticket as intended by the owner or operator of the event.

Another approach to verification of payment of a general admission price uses a wrist band which is locked to the wrist by a snap mechanism and which can be removed only by breaking the snap mechanism which cannot then be relocked. The security afforded by a wrist band however, can be breached by cutting the band itself and taping the two cut ends back together. Further, often the wrist band can simply be slipped over the hand especially if not properly applied in the first instance.

Another approach, of the type commonly used as ski resorts, involves a ticket having pressure sensitive adhesive on one side thereof, used in combination with a metal wire slipped through, for example, the eyelet of a zipper. This approach is also subject to abuse in that the article of clothing carrying the ticket can be transferred to another person.

SUMMARY OF THE INVENTION

Accordingly, it is an object of the present invention to provide a ticketing system where persons having paid for admission to an event, amusement park, etc., are provided with a proof of payment which cannot be transferred to another.

It is another object of the present invention to provide a ticket receipt in the form of a "tattoo" transferrable to the skin of the purchaser at the time of payment for admission to the event, amusement park, etc.

In furtherance of the objects mentioned above, the present invention provides a strip of tickets numbered in numerical sequence, with the tickets being connected end-to-end to form the strip. The strip of tickets is provided with widthwise rows of perforations, each row of perforations serving to separate and define separate tickets. The rows of perforations extend across the width of the strip to allow single tickets to be separated from the strip one-by-one. Each of the tickets includes a substrate element and an indicia coating, with the indicia coating formed of transferrable ink or dye graphics. Optionally, the transferrable ink or dye indicia may include, on each of the tickets, one number in the numerical sequence. The novel tickets of the present invention can incorporate any conventional temporary body tattoo transfer system. Preferably, the transferrable body tattoo system is of the type that transfers only the ink indicia, without transfer of a continuous film. In other words, preferably, the present invention allows for transfer of only disparate elements of indicia. As is conventional, the strip of tickets may optionally be formed into a roll.

In using the tickets of the present invention, upon payment of the admission price for the subject event or ride(s), the ticket or body member of the payor, typically the back of the payor's hand, is wetted with a transfer fluid and the ticket is pressed against the back of the hand and the substrate is removed leaving the ink indicia elements as a temporary "tattoo" on the back of the payor's hand.

The ink or dye indicia are typically formed of an oil dye which is soluble in lower alcohols but has very low water solubility. Many such dyes are known in the medicinal and cosmetic arts as being suitable for contact with human skin. Many such dies are disclosed in U.S. Pat. No. 4,169,169 issued to Kitabatake and entitled "Transfer Process and Transfer Sheet for Use Therein," the teachings of which are incorporated herein by reference. However, again, any "tattoo" system meeting the above-stated criteria can be used to form the novel tickets of the present invention.

DESCRIPTION OF THE PREFERRED EMBODIMENTS

Figure 1:
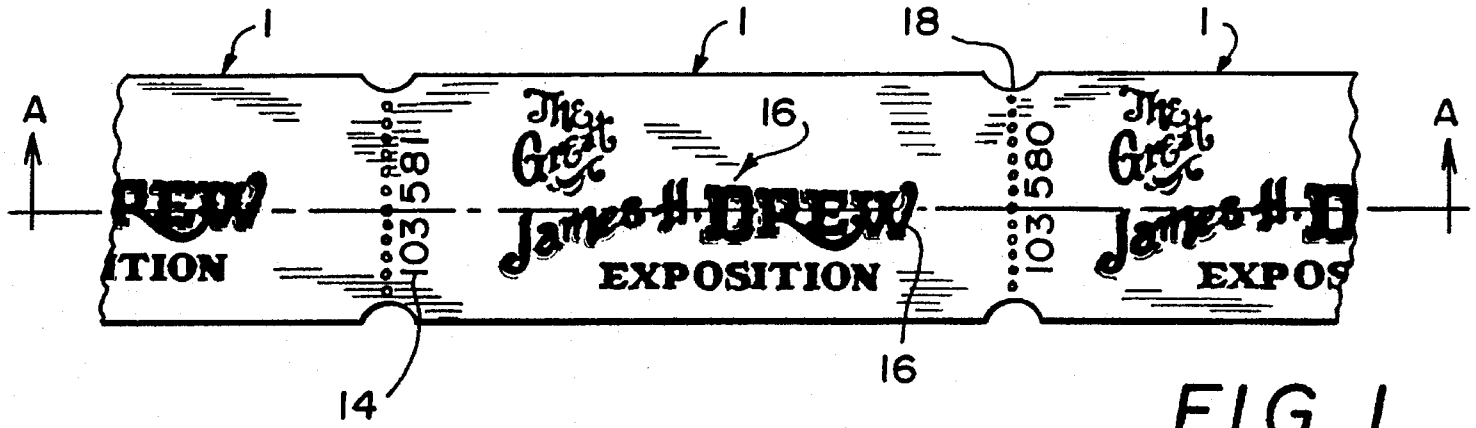
FIG. 1 is a plan view of a portion of a strip of tickets in accordance with the present invention.
Figure 2:
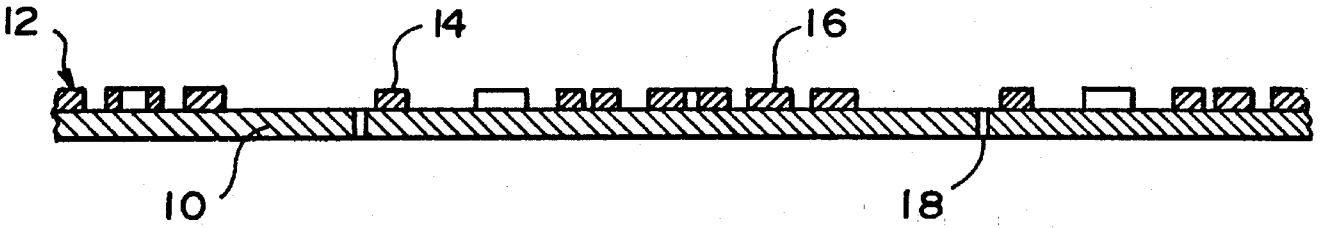
FIG. 2 is a cross-sectional view of the ticket strip section of FIG. 1 taken along cutting line A—A in FIG. 1.
Figure 3:
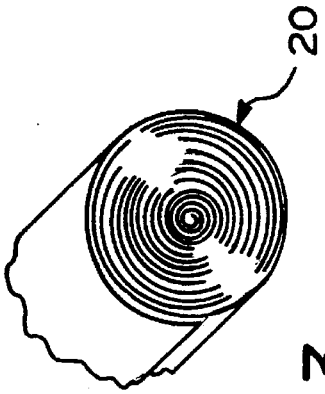
FIG. 3 is a schematic view of a roll formed from a ticket strip as illustrated in FIG. 1.

As shown in FIGS. 1 and 2, each ticket 1 is composed of a substrate layer 10 and an indicia layer 12. The indicia of layer 12 include discrete graphic elements 16 and numerals 14. As noted above, numerals 14 may simply be printed onto each of the tickets 1 as opposed to forming a portion of the transferrable indicia of layer 12. Tickets 1 are each separated by a row of perforations 18. The ticket strip may, optionally, be formed into a roll as shown in FIG. 3.

The substrate 10 may be any substrate conventionally used as a substrate for a "tattoo." Suitable substrates include paper, plastic and composites thereof. Ordinary ticket stock is suitable because it possesses the capability of absorbing the transfer fluid used in applying the indicia to the skin. However, other papers, especially "blotting papers" may advantageously be used as the substrate 10. The indicia layer 12 is formed of a transferrable die or ink which is applied to the substrate 10 by a conventional method, for example by silk screen printing or photogravure printing. Typically, the thickness of the ink or die layer 12 (indicia layer) will be on the order of 10 microns or less. As noted above, any die or ink conventionally used for "body tattoos" may be used provided it meets the criteria of water resistance and washability suitable for satisfaction of the objectives noted above. In other words, the ink, once transferred to the skin, should be sufficiently water resistant to withstand the effects of perspiration, etc., for four to twelve hours yet not so water resistant as to resist removal by repeated washings with soap and water. Dyes meeting such criteria include oil dyes which are soluble in lower alcohols but relatively water insoluble. A number of such suitable dyes are disclosed in the aforementioned Kitabatake U.S. patent.

The dye will typically be formulated into an ink composition in order to form the indica of layer 12. In addition to the dye, the ink will typically contain a binder, a solvent, a plasticizer and, optionally, other additives. Film-forming plastics approved for the packaging of foodstuffs serve as suitable binders for the ink compositions used in the present invention, e.g. cellulose ethers, cellulose esters and partially saponified polyvinylacetate.

The process of transferring the indicia from the ticket onto the skin is a simple, quick procedure. It involves simply application of a transfer solution to the skin by any convenient means, e.g. a spray or a sponge. The transfer solution is of a nature dictated by the type of dye present in the indicia. For the aforementioned oil dyes, ordinary rubbing alcohol (isopropyl alcohol) or a denatured alcohol may be applied to the skin and the indicia bearing side of the ticket is then pressed against the wetted area of the skin for a suitable period of time, i.e. 2–10 seconds. While the "tattoo" may be removed by repeated washings with soap and water, it may be more quickly removed by use of a lower alcohol on a cotton swab.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

I claim:

1. A set of admission tickets numbered in numerical sequence and interconnected with rows of perforations serving to separate and define separate tickets, each of said tickets comprising a substrate element and an indicia coating on said substrate element, said indicia coating being formed of an ink transferrable to human skin by wetting with a transfer solution to form a water-washable marking thereon and said substrate element comprising a transfer solution-absorbing paper.

2. A set of tickets in accordance with claim 1 connected end-to-end to form a strip with said rows of perforations running widthwise across the strip.

3. A set of tickets in accordance with claim 1 wherein said transferrable ink indicia on each ticket includes one number in said numerical sequence.

4. A set of tickets in accordance with claim 1 wherein said ink is transferrable to human skin as disparate elements of indicia, without transfer of a continuous film from the ticket to the human skin.

5. A set of tickets in accordance with claim in the form of a strip rolled into a roll.

6. A strip of tickets in accordance with claim 5 wherein said transferrable ink indicia on each ticket includes one number in said numerical sequence.

7. A strip of tickets in accordance with claim 5 wherein said ink is transferrable to human skin as disparate elements of indicia, without transfer of a continuous film from the ticket to the human skin.

8. A set of tickets in accordance with claim 1 wherein said ink comprises a dye.

9. A set of tickets in accordance with claim 8 wherein said dye is an oil dye.

* * * * *